US006015146A

United States Patent [19]

Siegel

[11] Patent Number: 6,015,146

[45] Date of Patent: Jan. 18, 2000

[54] CURL SENSITIVE BOTTOM VACUUM CORRUGATION FEEDER

[75] Inventor: Robert P. Siegel, Penfield, N.Y.

[73] Assignee: Xerox Corporation, Stamford, Conn.

[21] Appl. No.: 09/004,252

[22] Filed: Jan. 8, 1998

[51] Int. Cl.[7] ..... B65H 3/48

[52] U.S. Cl. ..... 271/98; 271/96; 271/105

[58] Field of Search ..... 271/94, 96, 98, 271/105, 106, 265.01, 93

[56] References Cited

U.S. PATENT DOCUMENTS

| | | | |
|---|---|---|---|
| 4,305,576 | 12/1981 | Hamlin | 271/11 |
| 4,382,593 | 5/1983 | Beran et al. | 271/12 |
| 4,411,417 | 10/1983 | Browne | 271/94 |
| 4,638,986 | 1/1987 | Huggins et al. | 271/96 X |
| 4,662,622 | 5/1987 | Wimmer et al. | 271/96 |
| 5,088,713 | 2/1992 | Hayashi | 271/96 X |
| 5,138,178 | 8/1992 | Wong et al. | 250/559 |
| 5,184,813 | 2/1993 | Schwitzky et al. | 271/98 |
| 5,213,320 | 5/1993 | Hirota et al. | 271/96 X |
| 5,356,127 | 10/1994 | Moore et al. | 271/96 X |
| 5,454,556 | 10/1995 | Siegel | 271/98 |
| 5,461,467 | 10/1995 | Malachowski | 355/312 |

FOREIGN PATENT DOCUMENTS

| | | |
|---|---|---|
| 0 662 646 A2 | 7/1995 | European Pat. Off. . |
| 0061248 | 5/1981 | Japan . |
| 356099143 | 8/1981 | Japan . |
| 363027361 | 2/1988 | Japan . |
| 404003739 | 1/1992 | Japan . |

*Primary Examiner*—Christopher P. Ellis
*Assistant Examiner*—Patrick Mackey

[57] ABSTRACT

An arrangement for controlling feeding in a bottom vacuum corrugation feeder when sheets with curl are encountered includes a timer and a sensor for detecting the negative pressure level in a vacuum plenum of the vacuum feeder. The vacuum pressure sensor gives a signal proportional to the degree of vacuum behind feeder belt holes that are in communication with the vacuum plenum. The vacuum pressure sensor is used to measure the instantaneous level of vacuum in the plenum, as well as, to detect the point at which sheet acquisition has occurred. The sensor is interrogated at predetermined intervals during the acquisition portion of the feed cycle. At each interval, the current pressure level detected in the vacuum plenum by the vacuum pressure sensor is compared to a reference value for that interval. Depending on whether the pressure is above or below the reference level, a controller will either decrease or increase air knife pressure or vacuum pressure in order to maintain sheet acquisition time within a nominal window regardless of stack size, paper weight or paper curl.

1 Claim, 5 Drawing Sheets

CURL SENSITIVE BOTTOM VACUUM CORRUGATION FEEDER

BACKGROUND OF THE INVENTION

1. Field of the Invention.

The present invention relates to sheet feeding, and more particularly, to a vacuum corrugation feeder with the capability of detecting the degree of curl in sheets.

2. Description of the Prior Art.

With the advent of high speed xerographic copy reproduction machines wherein copies can be produce at a rate in excess of three thousand copies per hour, the need for a document and sheet feeder to, for example, feed documents to the platen of a copier in rapid succession in a reliable and dependable manner in order to utilize the full capabilities of the copier. A number of document handlers are currently available to fill that need. These document handlers must operate flawlessly to virtually eliminate the risk of damaging the original document and generate minimum machine shutdowns due to misfeeds or document multifeeds. It is in the initial separation of the individual documents from the document stack where the greatest number of problems occur which, in some cases, can be due to upcurl and downcurled in documents.

Since the documents must be handled gently but positively to assure separation without damage through a number of cycles, a number of solutions have been suggested such as friction rolls or belts used for fairly positive document feeding in conjunction with a retard belt, pad, or roll to prevent multifeeds. Vacuum separators such a sniffer tubes, rocker type vacuum rolls, or vacuum feed belts have also been utilized.

While the friction roll-retard systems are very positive, the action of the retard member if it acts upon the printed face can cause smearing or partial erasure of the printed material on the document With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

Various approaches have been highly successful in answering the above problems, for example U.S. Pat. No. 4,305,576 discloses a typical vacuum separating and feeding system wherein a plurality of friction belts is arranged to run over a vacuum plenum placed at the bottom of a sheet supply tray which has a "U" shaped pocket formed in it. The pocket serves to provide space for the bottom sheet to be captured by the vacuum feed belt assembly, to provide an air seal between the bottom sheet and the edges of the pocket and to provide a high pressure seal between the bottom sheet and the remainder of the stack. This high pressure seal is achieved by supporting a major portion of the stack weight on the edge regions of the pocket. However, this "U" shaped configuration was found to not permit deformation of the sheet in a geometrically developable shape which results in a reduction in the degree of levitation of the sheet stack.

The bottom sheet vacuum corrugation feeder in U.S. Pat. No. 4,411,417 answered this problem by including a differently designed stack support tray that has a planar base portion defining a base plane, the front of the base portion having a opening within which the bottom sheet separator is positioned. The tray also includes two sloping planar side wings, one at each side of the opening in the base portion. The sloping planar side wings are angled upward from the base plane and are angled outward from front to rear of the tray and intersect the base plane such that the intersection at the rear of the tray is in the approximate location of the rear corners of a rectangle the size of a sheet to be fed and the intersection of the planar wings and the base plane at the front of the tray is approximately midway between the front corners of a sheet to be fed and the center line of a sheet to be fed.

The performance of the heretofore mentioned bottom vacuum corrugation feeders (BVCF) depend on the fine balance between the two critical pneumatic parameters, air knife pressure which determines the degree of stack levitation and vacuum pressure which determine the acquisition force and the forward driving force. Any imbalance which favors the air knife will tend to lead to misfeeds while an imbalance favoring the vacuum will lead to multifeeds. In high performance copiers and printers, the air knife pressure is controlled by selecting one of four discrete pressure levels. The input to this controller is the position of the stack height sensor. A high stack will require a high air knife and a low stack will be best served by a low air knife setting. The problem which tends to arise has to do with paper curl. Not only is paper curl more difficult to acquire, since the lead edge may e elevated with respect to the feed belt, but it may also fool the stack height sensor into indicating a high stack. This will give exactly the wrong response, that of a high air knife when the lead edge is already curled away.

U.S. Pat. No. 5,454,556 is one attempt at answering this problem and includes a BCVF with a vacuum switch that changes state at a preset vacuum level thereby detecting any significant rise in vacuum which occurs when a sheet has been acquired from a sheet stack by the BCVF. A digital control circuit senses the change of state which takes place in the vacuum switch and feeds a signal to a machines' microprocessor which in turn signals an air knife in the BVCF to increase or decrease air pressure toward the sheet stack to compensate for the stressed state of the sheets. Even with this improvement, there is still a need for a BVCF that is more sensitive to sheet Curl.

SUMMARY OF THE INVENTION

Accordingly, in an aspect of this invention, an arrangement for controlling feeding in a bottom vacuum corrugation feeder when sheets with curl are encountered includes a timer and a sensor for detecting the negative pressure level in a vacuum plenum of the vacuum feeder. This low cost vacuum pressure sensor gives a signal proportional to the degree of vacuum behind feeder belt holes that are in communication with the vacuum plenum. The vacuum pressure sensor can be used to measure the instantaneous level of vacuum in the plenum, as well as, to detect the point at which acquisition has occurred. The sensor will be interrogated at predetermined intervals during the acquisition portion of the feed cycle. At each interval, the current pressure level detected in the vacuum plenum by the vacuum pressure sensor is compared to a reference value for that interval. Depending on whether the pressure is above or below the reference level, a controller will either decrease or increase air knife pressure or vacuum pressure in order to maintain sheet acquisition time within a nominal window regardless of stack size, paper weight or paper curl.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the bottom vacuum corrugation feeder apparatus for a copier/printer in FIG. 3. However, it should be understood that the curl sensitive method and apparatus of the present invention could be used with a top vacuum corrugation feeder or vacuum feeders in general.

Figure 1:
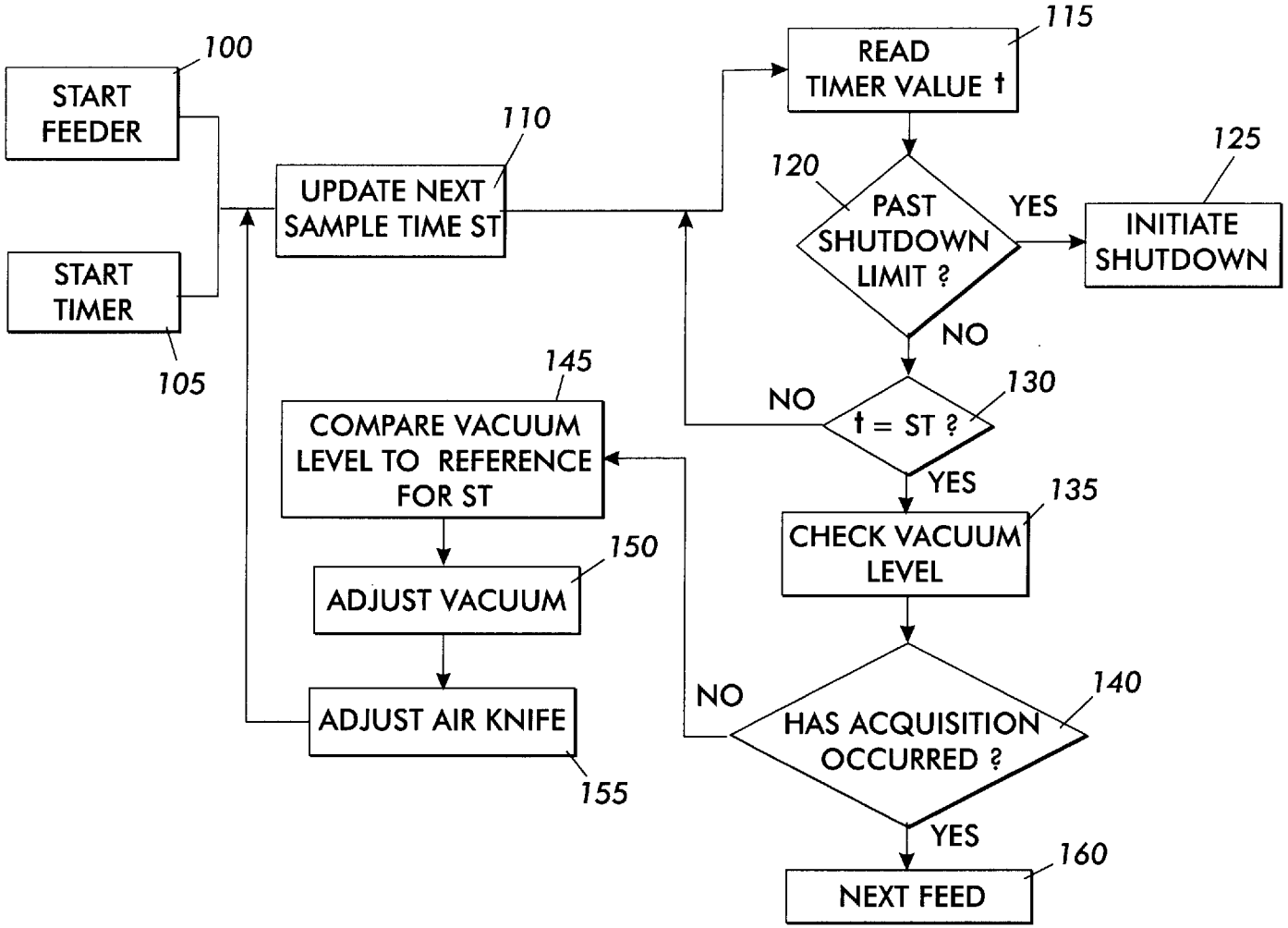
FIG. 1 is a flow chart showing inputs for air knife and vacuum pressure control in a real time mode in accordance with the present invention.

In general, curl in sheets can be compensated for in accordance with the present invention as shown in the flow diagram of FIG. 1 which illustrates the sequence of operation of a vacuum feeder, a timer, a vacuum sensor and a controller for controlling the air knife pressure and vacuum pressure on sheets fed from the vacuum feeder in a real time mode, that is, as each sheet is being fed. The vacuum feeder includes a vacuum plenum onto which sheets are drawn and forwarded out of the feeder for further processing. The feeder is started in block 100 and simultaneously a timer is started in block 105. At this point, the next sample time (ST),which is stored in memory, is updated in block 110 and the timer is read in block 115 to determine in block 120 if the time is past a predetermined shutdown limit. If the time is past the shutdown limit, shutdown of the vacuum feeder is initiated. If the time is not past the shutdown limit, the current timer value is compared to the time-to-sample ST which has been updated in block 110. The controller will continue to check the timer value and compare it to the next sample time until the elapsed time is equal to the next sample time. When it is, the pressure sensor is interrogated in Block 135 and the value of the plenum vacuum level is acquired into the memory of the controller. The plenum pressure value is then checked by the controller to see if a sheet has been acquired in block 140 and if it has feeding will proceed. If a sheet had not been acquired, a signal is sent by a controller to check the vacuum level in block 140. This vacuum level is compared to a reference vacuum level for ST and depending on the readout an adjustment is made in block 150 to the vacuum pressure and an adjustment is make to air knife pressure in block 160 with these adjustment being sent to update sample time ST in block 110.

The vacuum pressure is generally used to respond in the opposite direction from the air knife. Thus, in the case of late acquisition, the air knife is decreased while the vacuum flow is increased. A truth table of this algorithm is as follows:

| Acquisition | Very Low | Low | Normal | High | Very High |
|---|---|---|---|---|---|
| Air Knife | Reduce + | Reduce | Leave Set | Increase | Increase + |
| Vacuum | Increase | Leave Set | Leave Set | Leave Set | Reduce |
| Basic Weight | Very Light | Light | Normal | Heavy | Very Heavy |
| Curl | Upcurl | Slight Upcurl | Normal | Slight Downcurl | Down-curl |

The first two rows of the above truth table are suggested settings. The last two rows are the indicated conditions. Conventional fuzzy logic can be used for implementation.

Figure 2:
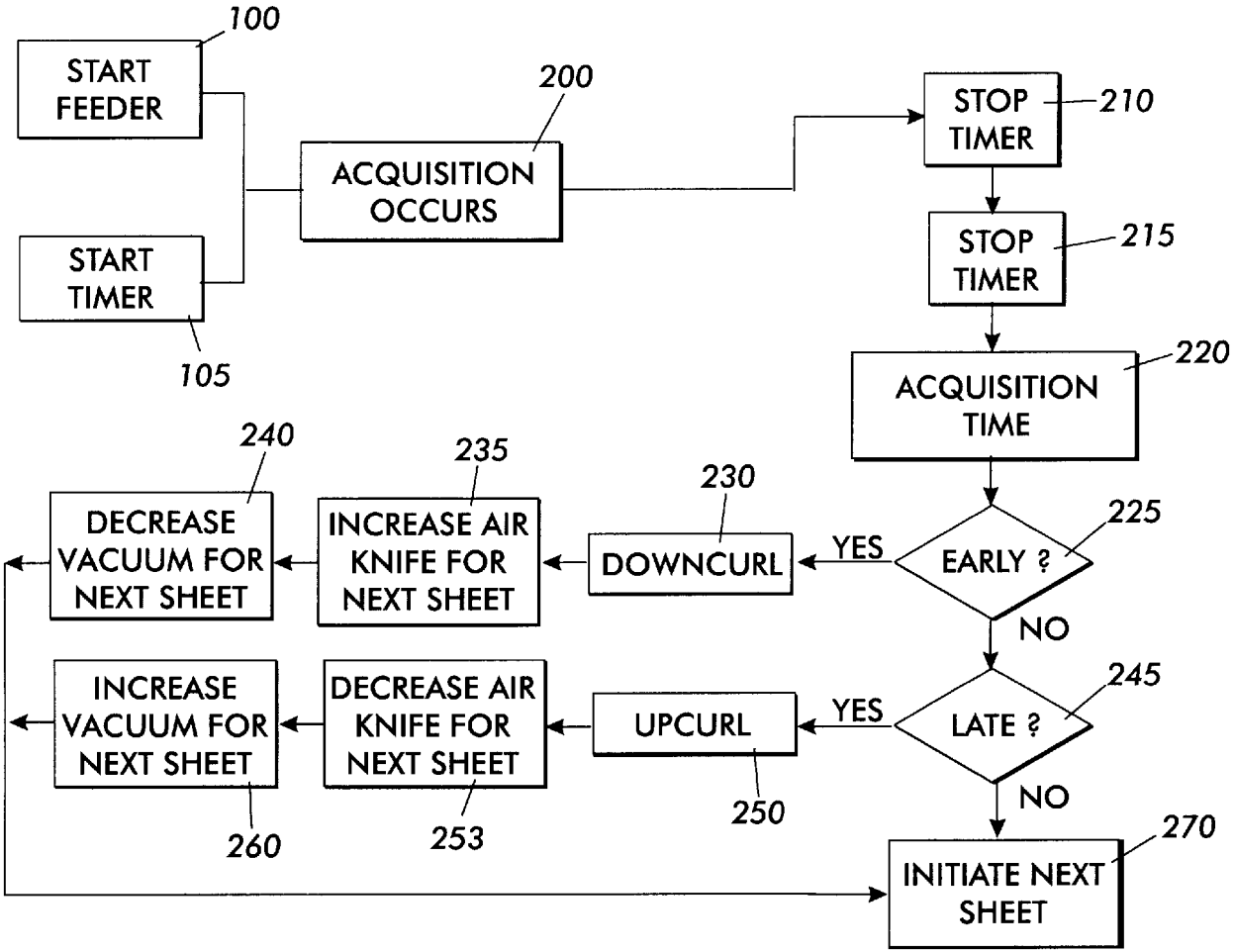
FIG. 2 is a flow chart showing inputs for controlling air knife and vacuum pressure in accordance with the present invention in a next sheet mode.

__ of FIG. 2 depicts the sequence of controller control of the vacuum feeder in the next sheet mode. The vacuum feeder includes a vacuum plenum onto which sheets are drawn and forwarded out of the feeder for further processing. The feeder is started in block 100 and simultaneously a timer is started in block 105. Once a sheet is drawn against the vacuum plenum and acquisition occurs as in block 200, the timer is stopped at block 210 and read in block 215 to give a signal as to acquisition time as indicated by block 220. An early acquisition time as compared to a nominal acquisition time stored in the controller indicates downcurl in block 230 and in this case air knife pressure is increased for the next sheet and vacuum pressure is decreased for the next sheet. If the acquisition time in block 220 is late with respect to a reference time as determined in block 245, upcurl is indicated and air knife pressure is decreased in block 255 while vacuum pressure in block 260 is simultaneously increased for the next sheet that is to be fed.

Generally, the heretofore mentioned algorithms of FIGS. 1 and 2 can be used either in a real time mode as shown in FIG. 1 or a next sheet mode as shown in FIG. 2. In a real time mode of FIG. 1, if predetermined mili-seconds have passed and the sheet has not acquired yet, a controller will decrease the air knife pressure and increase the vacuum pressure. This will reduce the risk of misfeeds. If the sheet acquired very quickly, the air knife pressure can be increased and the vacuum pressure reduced before the feed clutch is actuated. This will reduce the risk of multi-feeds. A major benefit to the real time mode is that this system will enable reliable feeding of mixed sheets (curl and basis weight) in a stack.

In the next sheet mode of FIG. 2, the feeder uses the information from the previous sheet to set up for the next feed. This is always a benefit to the next sheet, assuming the current sheet does not jam. The advantage of this mode is that it is easier to implement and more complete information is available.

Figure 3:
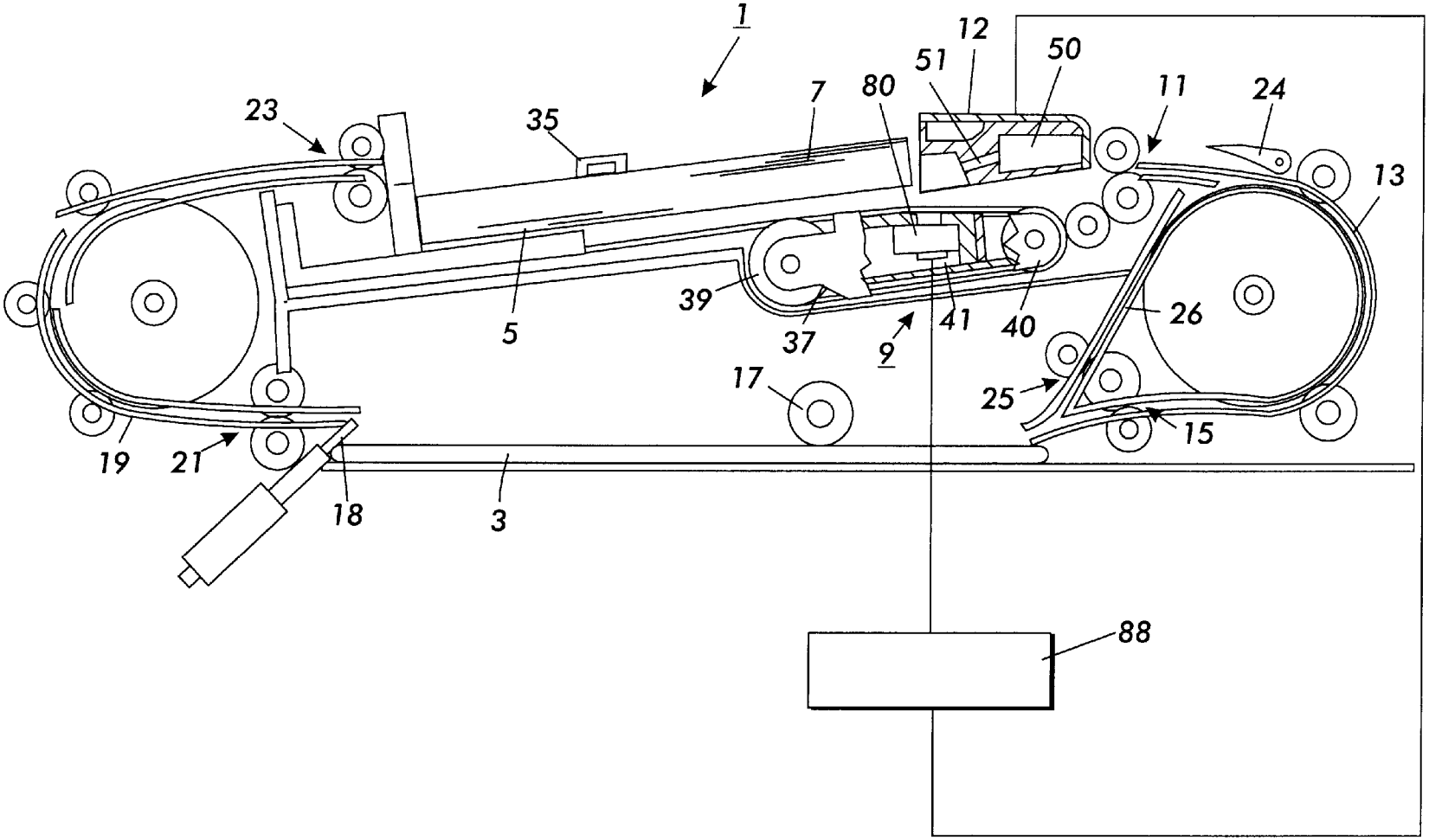
FIG. 3 is a cross sectional side view of an exemplary sheet separator-feeder employing the present invention.

Referring now particularly to FIG. 3, there is illustrated an exemplary automatic sheet separator-feeder for installation over the exposure platen 3 of a conventional xerographic reproduction machine, however, the principle of this invention and document handler 1 could also be used as a copy sheet feeding apparatus or duplex tray feeder with obvious modifications. This is merely one example of a document handler with which the exemplary sheet separator-feeder improvements of the present invention may be combined. The document handler 1 is provided with a document tray 5 which will be described in greater detail later, adapted for supporting a stacked set of documents 7. A vacuum belt corrugating feeding mechanism 9 is located below the front or forward area of the document tray for acquiring and corrugating the bottom document sheet in the stack and for feeding out that document sheet to take-away roll pair 11 through document guides 13 to a feed-roll pair 15 and under platen roll 17 onto the platen of the copy machine for reproduction. A retractable registration edge 18 is provided here to register the lead edge of the document fed onto the platen. Following exposure of the document, the edge 18 is retracted by suitable means such as solenoid and that document is fed off the platen by roll 17 onto guide 19 and feed-roll pair 21 and returned back to the top of the document stack through a feed-roll pair 23. Gross restacking lateral realignment is provided by a edge guide (not shown) resettable to a standard sheet site distance from an opposing fixed edge guide.

In the event it is desired to present the opposite side of a document for exposure, the document is fed from the stack 7 through guides 13 until the trail edge passes document diverter 24. Document diverter 24 is then rotated counterclockwise, i.e., into the document sheet path. The document direction is reversed and the document is diverted by diverter 24 through guides 26 and feed-roll pair 25 onto the platen 3.

The document handler 1 is also provided with a sheet separator finger 35 as is well known in the art, to sense and indicate the documents to be fed versus those documents returned to the document handler, i.e., to count each set circulated. Upon removal (feed out) of the last document from beneath sheet separator finger 35, the finger drops through a slot provided in the tray 5 to actuate a suitable sensor indicating that the last document in the set has been removed from the tray. The finger 35 is then automatically rotated in a clockwise direction or otherwise lifted to again come to rest on top of all the documents in the stack 7, for the start of the next circulation of document set 7.

Figure 4:
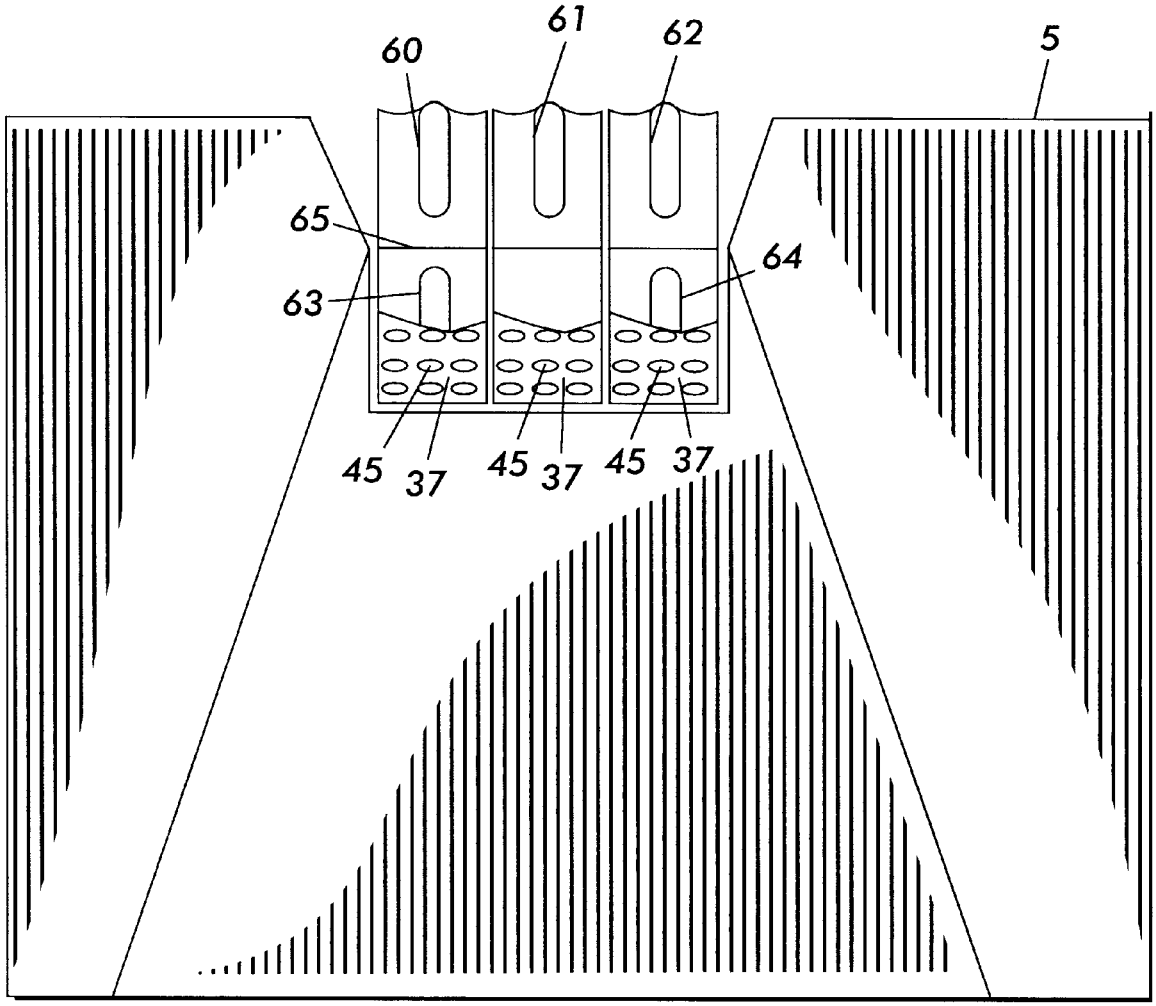
FIG. 4 is a plan view of the sheet separator-feeder showing the sheet stacking and holed belts surrounding a vacuum plenum.
Figure 5:
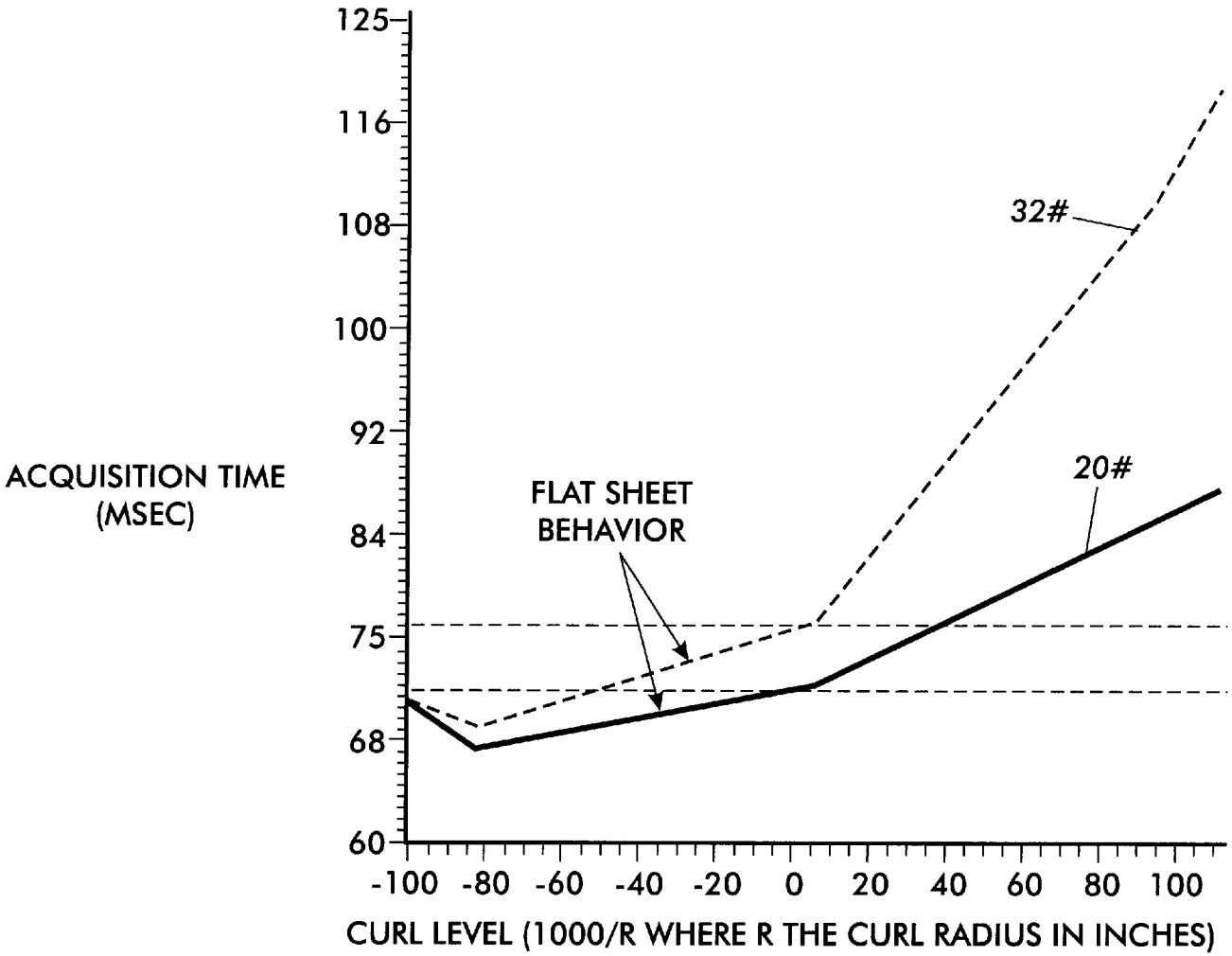
FIG. 5 is a chart showing sheet acquisition sensing times for different curl levels.

Referring more particularly to FIGS. 3 and 4, and the document sheet separator-feeder 9, there is disclosed a plurality of feed belts 37 supported for movement on feed belt rolls, 39 and 40. Spaced within the run of the belts 37 there is provided a vacuum plenum 41 having a support plate and openings therein adapted for cooperation with perforations 45 of about 3 mm in the belts 37 to provide a vacuum for pulling the bottom document in the document stack onto the belts 37. The plenum 41 is bi-level sloped and provided with raised portions 60–64 that are below the belts 37 so that upon capture of the bottom document in the stack against the belts a corrugation will be developed in the sheet thereby enhancing its separation from the rest of the stack. This increased separation is due to the corrugation gaps placed in the sheet that reduce the vacuum pressure levels between the sheets due to porosity in the first (bottom) sheet and provide for entry of the separating air flow from the air knife 12.

The air knife 12 is comprised of a pressurized air plenum 50 having a plurality of separated air orifices 51 to inject air between the bottommost document pulled down against the feed belts and the documents in the stack thereabove to provide a air cushion or bearing between the stack and the bottom document to minimize the force needed for removing the bottom document from the stack.

By suitable valving and controls, it is also desirable to provide a delay between the time the vacuum is applied to pull the document onto the feed belts and the start up of the feed belts, to assure that the bottom document is captured on the belts before belt movement commences and to allow time for the air knife to separate the bottom sheet from any sheets that were pulled down with it.

Turning now to the present invention more particularly, present vacuum corrugation feeders sometimes have difficulties feeding stressed or curled sheets with the consequence that sheets do not reach particular subsystems within required time spans. An answer to this problem is shown in FIG. 1 and includes a conventional low cost vacuum switch 80 placed within vacuum transport plenum 41 that enhances performance of the feeder through closed loop air system control as described herein below. Pressure sensor 80 is commercially available from Data Instruments, Acton, Mass. and is used to measure the instantaneous level of vacuum in the plenum 41, as well as, to detect the point at which sheet acquisition has occurred. The sensor is interrogated at predetermined intervals during the acquisition portion of the feed cycle. At each interval, the current pressure level detected in the vacuum plenum by the vacuum pressure sensor is compared to a reference value for that interval. Depending on whether the pressure is above or below the reference level, a controller 88 will either decrease or increase air knife pressure or vacuum pressure in order to maintain sheet acquisition time within a nominal window regardless of stack size, paper weight or paper curl. Pressure sensor 80 can be installed either directly in the vacuum plenum as shown or in the duct which connects the plenum to the blower, as desired. The sensor will detect any significant rise in vacuum while the bottommost sheet in the document stack 7 is pulled onto the perforated belts 37 that surround the vacuum plenum 41, thus sealing the air system and creating the characteristic closed port pressure.

Studies have shown a distinct correlation between the curl level present in a sheet and the time required to acquire the sheet. For example, in FIG. 4, the chart shows a preferential sensitivity to upcurl, part of which is inherent due to interactions with the air knife. The characteristic response exhibits sufficient sensitivity suitable for microprocessor control. Although lightweight sheets show relatively little change in acquisition time as a function of curl, this is not viewed as problem, since the curl level of lightweight sheets is generally seen to be of little consequence in setting machine parameters.

In conclusion, the performance of some bottom vacuum corrugation feeders depend on a fine balance between air knife pressure which levitates a stack, and vacuum pressure which supplies the acquisition force and the forward driving force. The input for control is the position of a stack height sensor: a high stack requiring a high air knife setting and a low stack requiring a low air knife setting. Paper curl can cause the sensor to detect a wrong stack height. The present invention addresses this optimization problem by employing: (1) a plenum vacuum pressure sensor that gives a signal while a sheet is in the process of being acquired and when the sheet is acquired, and (2) a machine control algorithm that is used to vary air and vacuum pressure accordingly.

It is, therefore, evident that there has been provided in accordance with the present invention a nip sheet sensing scheme has been disclosed which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A bottom sheet separator-feeder for separating and forwarding sheets seriatim from the bottom of a stack of sheets to be fed including curled sheets, in feed cycles, during a portion of which sheet acquistion occurs for different sheets at different times comprising: a stacking tray having a surface for supporting a stack of sheets to be fed; a variable pressure air knife positioned opposite the sheet stack and adapted to separate the bottommost sheet in the stack from the remainder of the stack; a plurality of apertured endless vacuum feed belts extending through at least the front end of said sheet stacking tray for acquiring and advancing the bottom sheet of the stack; said plurality of apertured endless vacuum feed belts extending across a vacuum chamber that includes a support plate for supporting said belts having vacuum ports therein for applying a variable negative vacuum pressure at the back of and through said belts; and an arrangement for adjusting the air pressure of the air knife against the stack regardless of sheet stack size, sheet weight or sheet curl, said arrangement including a vacuum pressure sensor positioned within said vacuum chamber and adapted to give off instantaneous electrical signals, relative to a reference value electrical signal, proportional to the degree of vacuum behind said apertured belts for detecting the point at which said sheet acquisition has occurred, and wherein said pressure sensor is interrogated at multiple predetermined time intervals during said acquisition portion of said feed cycle, and at each said interval, said degree of vacuum detected in said vacuum chamber by said vacuum pressure sensor is compared to said reference value for said interval to determine whether said degree of vacuum within said vacuum chamber is above or below said reference value, and a microprocessor controller adapted to receive said signals from said pressure sensor to determine when said acquisition has occurred and to either decrease or increase said air knife pressure or said vacuum pressure in order to maintain said sheet acquisition time within a preset nominal window within a said feed cycle regardless of stack size, paper weight or paper curl.

* * * * *